US006637504B2

(12) United States Patent
Jackson

(10) Patent No.: US 6,637,504 B2
(45) Date of Patent: Oct. 28, 2003

(54) INSTALLATION FOR RECOVERING DEBRIS STOPPED BY A FILTER AT THE INLET OF A HEAT EXCHANGER

(75) Inventor: Philip Jackson, Paris (FR)

(73) Assignee: E. Beaudrey et Cie, Paris (FR)

( * ) Notice: Subject to any disclaimer, the term of this patent is extended or adjusted under 35 U.S.C. 154(b) by 0 days.

(21) Appl. No.: 10/142,772

(22) Filed: May 13, 2002

(65) Prior Publication Data

US 2002/0170704 A1 Nov. 21, 2002

(30) Foreign Application Priority Data

May 11, 2001 (FR) ..... 01 06254

(51) Int. Cl.[7] ..... F28F 19/00; C02F 1/02; C02F 9/00; B01D 21/00; B01D 29/00

(52) U.S. Cl. ..... 165/119; 165/95; 210/308; 210/312; 210/313; 210/416.1; 210/196; 210/181

(58) Field of Search ..... 165/95, 119, 303; 210/300, 301, 308, 312, 313, 181, 182, 167, 416.1, 196, 195.1

(56) References Cited

U.S. PATENT DOCUMENTS

| | | | | | |
|---|---|---|---|---|---|
| 3,726,239 | A | * | 4/1973 | Burbach | 110/345 |
| 3,882,931 | A | | 5/1975 | Kumagai | |
| 3,977,218 | A | * | 8/1976 | Zucchini | 210/314 |
| 4,867,879 | A | * | 9/1989 | Muller | |
| 5,116,473 | A | * | 5/1992 | Bostjancic | 159/42 |
| 5,975,311 | A | * | 11/1999 | Jackson | 210/393 |
| 6,530,427 | B1 | * | 3/2003 | Jackson | 122/380 |

FOREIGN PATENT DOCUMENTS

| | | | |
|---|---|---|---|
| DE | 26 13 835 | | 10/1976 |
| DE | 3428428 | | 2/1985 |
| EP | 1 098 158 | | 5/2001 |
| JP | 358175795 | A * | 10/1983 |

* cited by examiner

*Primary Examiner*—Henry Bennett
*Assistant Examiner*—Tho V Duong
(74) *Attorney, Agent, or Firm*—Young & Thompson

(57) ABSTRACT

An installation for recovering debris stopped by a filter at the inlet of a heat exchanger: a washing water manifold (36) at the outlet of the filter (11) feeds a separator (37) provided with an outlet pipe (39) for water free of debris to which is connected a hydro-ejector (50) which is connected to the outlet pipe (16) of the exchanger (19).

12 Claims, 2 Drawing Sheets

INSTALLATION FOR RECOVERING DEBRIS STOPPED BY A FILTER AT THE INLET OF A HEAT EXCHANGER

FIELD OF THE INVENTION

The present invention relates to an installation for recovering debris stopped by a filter at the inlet of a heat exchanger, for example a condenser.

SUMMARY OF THE INVENTION

According to the invention, an installation for recovering debris stopped by a filter at the input of a heat exchanger is characterized in that a washing water manifold at the outlet of the filter feeds a separator provided with an outlet pipe for water free of debris to which is connected an ejector nozzle which is connected to the outlet pipe of the exchanger.

The separator is advantageously substantially vertical and includes a central strainer passing through the body of the separator which has in its bottom portion an axial outlet controlled by a valve.

The outlet pipe for water free of debris preferably extends radially relative to the body of the separator.

The hydro-ejector advantageously includes an inlet elbow through whose external wall passes an ejector nozzle whose external end is connected to the outlet of a pump and whose internal end is frustoconical with the smaller base of the frustum of the cone at the same end as the ejector nozzle; the smaller base of the frustum of the cone is in the transverse plane at which a convergent section and a divergent section join together and said divergent section is extended by a pipe connected to the outlet pipe of the exchanger; the aspiration side of the pump is connected to said pipe.

The outlet pipe for water free of debris and the separator are preferably connected by pipework.

The outlet pipe for water free of debris advantageously includes a check valve.

The body of the separator preferably includes a vent.

In a preferred embodiment the filter includes a filter member in the general form of a wheel extending transversely in the body of the filter and adapted to rotate about the axis thereof.

BRIEF DESCRIPTION OF THE INVENTION

To explain the subject matter of the invention, an embodiment of the invention shown in the accompanying drawings is described next by way of purely illustrative and non-limiting example.

DETAILED DESCRIPTION OF THE INVENTION

Figure 1:
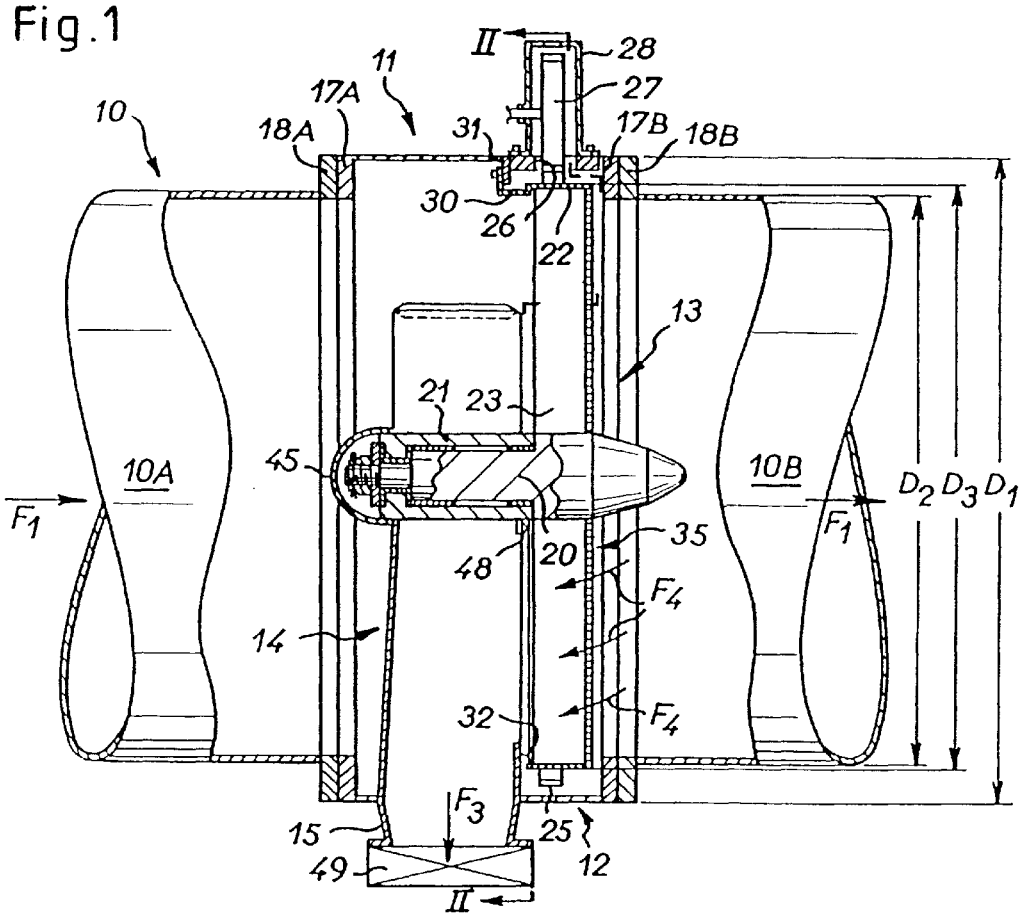
FIG. 1 is a view in section showing a filter disposed on the inlet pipe of a heat exchanger.

As shown in FIG. 1, a filter 11 is inserted into an inlet pipe 10, between successive upstream and downstream sections 10A, 10B thereof.

The filter 11 includes, in combination, in a filter body 12, a filter member 13, which has the general shape of a wheel, extends transversely in said filter body 12 and is adapted to rotate about the axis thereof and, disposed on the upstream side of said filter member 13, an aspiration member 14, which extends along a radius of the filter member 13 and to which an outlet pipe 15 is connected.

In practice, the filter body 12 advantageously takes the general form of a simple cylindrical shell whose diameter D1 is much larger than that D2 of the pipe 10 to which it is to be fitted, so that the diameter D3 of the filter member 13 is at least slightly greater than the latter.

The shell constituting the filter body 12 in this way is usually provided at its ends with flanges 17A, 17B, which are welded to it, for example, and by means of which it can be fastened, for example by means of nuts and bolts, to flanges 18A, 18B provided in a similar manner at the ends of the sections 10A, 10B of the pipe 10.

The filter member 13 projects cantilever-fashion into the filter body 12 and is in practice disposed at the end of a shaft 20 rotatably mounted in a hub 21 fastened to the filter body 12.

In practice, the filter member 13 has a peripheral rim 22 which is internally connected to the shaft 20 by spokes 23 and whose outside, by virtue of a rack 25 and through an opening 26 in the filter body 12, meshes with a drive wheel 27 disposed outside the filter body 12 and protected by a casing 28.

To prevent the flow to be treated, which travels from left to right in the embodiment shown, as shown by the arrows F1 in FIG. 1, short circuiting the filter member 13, a seal is provided between the filter body 12 and the rim 22 of the filter member 13; the seal is formed by an angle section 30 whose flange transverse to the overall axis is attached to the filter body 12 by means of an upstanding rim 31 thereon and directed radially towards said axis and whose other flange, which is elongate in the axial direction, is inserted in the rim 22 of the filter member 13, in the vicinity of the latter.

Of course, the resulting seal is interrupted locally at the location of the aspiration member 14, and the required seal at this location is provided by a lip 32 carried by the aspiration member 14.

The filter member 13 has a generally disc-shaped transverse filter element 35 between its rim 22 and its shaft 20, in practice on the downstream side of its spokes 23.

In practice, the spokes 23 of the filter member 13 divide the internal volume of its rim 22 into angular sectors.

Thus the internal volume of the rim 22 is transversely divided into a plurality of compartments.

Conjointly, the filter element 35 is itself divided into as many filter panels as there are compartments inside the rim 22, with one filter panel for each compartment.

The shaft 20 of the resulting filter member 13 preferably has a suitable hydrodynamic profile on the downstream side and is inserted on the upstream side into the hub 21 that carries it, with appropriate bearings between it and the hub, and appropriately keyed to the hub 21 in the axial direction.

An appropriately hydrodynamically profiled fairing 45 is attached to the hub 21 on the upstream side.

To support it, the hub 21 is connected to the shell constituting the filter body 1, on the one hand, by radial arms that extend at 120° in pairs and, on the other hand, by a box section which extends at 120° to the previously mentioned arms, constitutes an arm for the hub 21, and forms the aspiration member 14.

The box section forming the aspiration member 14 extends substantially vertically downward, and in elevation it has a triangular contour, occupying an angular sector of the filter member 13.

At its base, i.e. substantially where it passes through the shell constituting the filter body 12, the box section is connected to the associated evacuation pipe 15.

The evacuation pipe 15 extends substantially radially and has a flange at its end, in the usual way, for connecting it by means of a valve 49 and a pipe to aspiration means specified below.

On the same side as the filter member 13, the box section constituting the aspiration member 14 is substantially flush with the rim 22 and the spokes 23 of the filter member 13, and its corresponding wall includes an opening 48; the opening 48 has a globally quadrangular contour and is elongate in the manner of a buttonhole substantially along a radius of the filter member 13.

In use, the filter member 13 is normally stationary and the valve 49 controlling the evacuation pipe 15 is closed.

The debris, detritus or items conveyed by the treated flow are stopped by the filter element 35 of the filter member 13, to be more precise by its solid portions.

As and when they are stopped, they are stored in the compartments 29 provided for this purpose in the filter member 13.

From time to time, or whenever necessary, the filter member 13 is driven in rotation by the drive wheel 27 and at the same time the valve 49 controlling the evacuation pipe 15 is opened, as a result of which the box section constituting the aspiration member 14, which is then connected to the aspiration means, is subjected to an outwardly aspirated flow, as symbolized by the arrow F3 in FIG. 1, and the portions of the filter element 35 of the filter member 13 that the aspiration member 14 successively passes are subjected to contraflow circulation as they pass the opening 48 therein, as symbolized by arrows F4 in FIG. 1.

As a general rule, this contraflow circulation through the filter element 35 detaches and carries off to a drain debris, detritus or items which, previously stopped by the filter element 35, have until then been stored in the various compartments of the filter member 13.

The filter element 35 is therefore cleaned systematically, one portion at a time.

Figure 2:
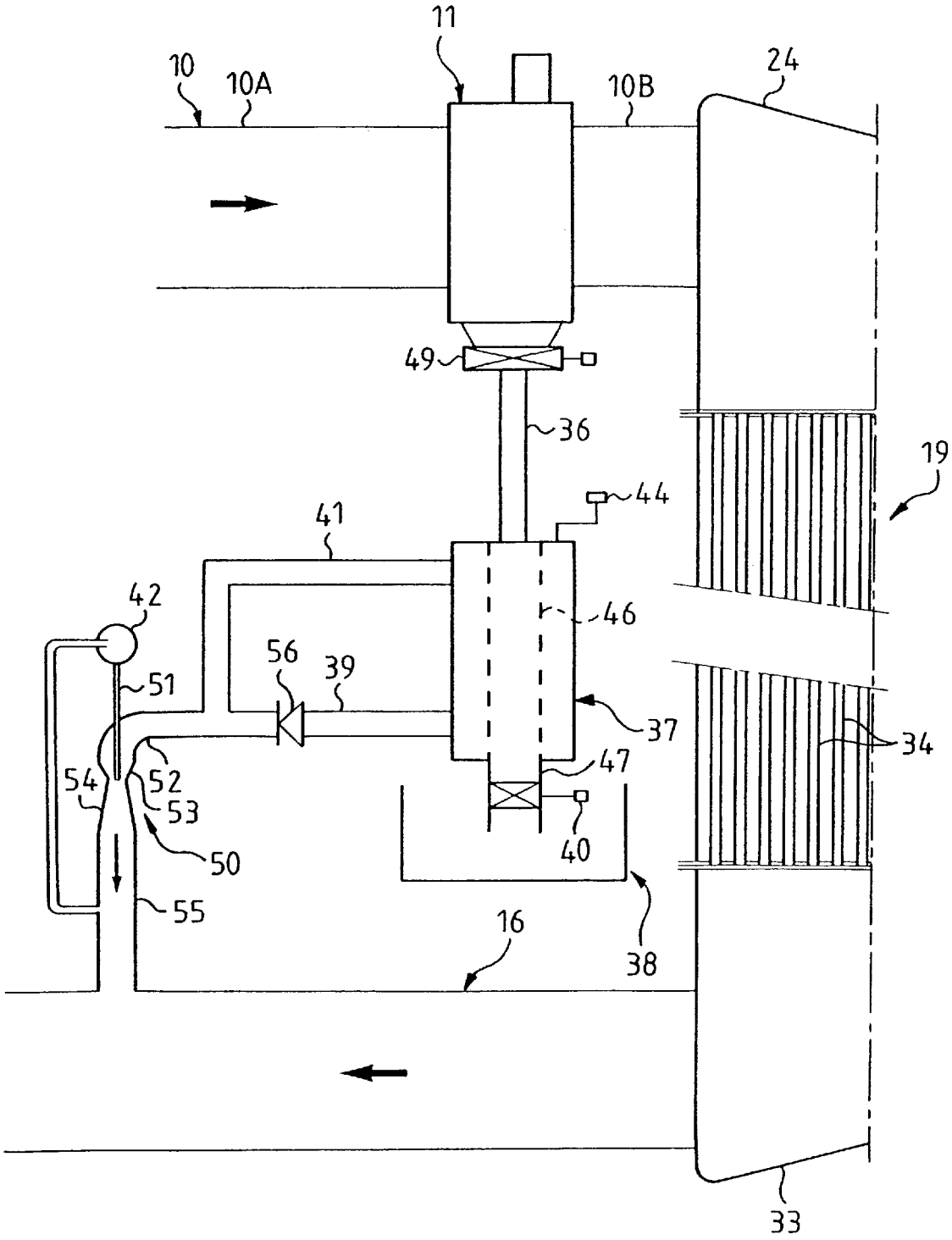
FIG. 2 is a diagram showing an installation according to the invention.

Referring to FIG. 2, it can be seen that the pipe 10 is the water inlet pipe of the condenser 19, connected to its inlet manifold 24; the water then passes through the tubes 34 and from the outlet manifold 33 to the outlet pipe 16.

As a general rule, the filter 11 is contraflow washed by the aspiration created by a siphon connected to the outlet pipe 16; in this case the washing water is entrained by the head loss of the condenser, which is low, or even very low, e.g. a few meters head of water; because of this, the debris is transported to the downstream side of the condenser and discharged to the natural environment, if the condenser cooling circuit is an open circuit, or recycled, if the condenser cooling circuit is a closed circuit; discharge to the natural environment in the case of open circuit cooling is less and less tolerated; in the case of closed circuit cooling the concentration of debris increases and eventually blocks the filters.

The invention provides for periodic interception and discharging of the debris by means of a static system to compensate the excess head loss through the installation.

Referring to the FIG. 2 diagram, it can be seen that a washing water manifold 36 at the outlet of the valve 49 directs the washing water into a static debris separator 37; the separator 37 is substantially vertical and includes a central perforated strainer 46 passing through the body of the separator 37 and of cylindrical shape, for example; the lower portion of the body of the separator 37 includes an axial outlet 47 which is therefore in line with the interior of the strainer 46, discharges to the open air and is controlled by a valve 40.

Under the outlet 47 is a container 38 for collecting debris, for example a perforated basket.

The lower portion of the separator body 37 is provided with a radial washing water outlet pipe 39 connected to an ejector nozzle 50; the water leaving the pipe 39 is free of debris, of course.

Figure 3:
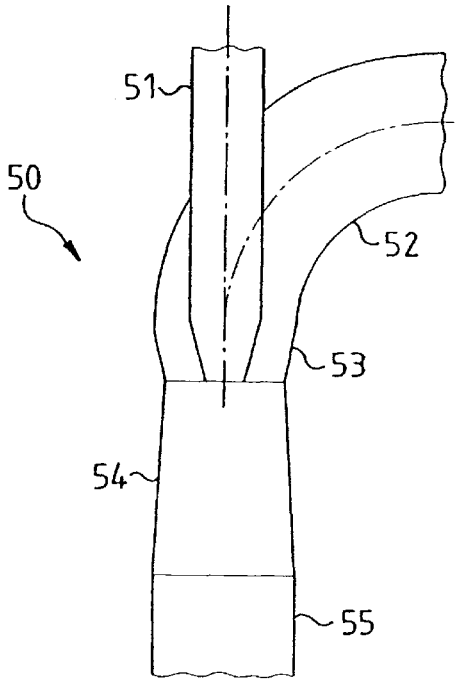
FIG. 3 is an enlarged view of the hydro-ejector from FIG. 2.

The hydro ejector nozzle 50, which can be seen better in FIG. 3, has an inlet elbow 52 through whose external wall passes an ejector nozzle 51 whose external end is connected to the outlet of a pump 42 and whose internal end is frustoconical, the smaller base of the frustum of the cone being at the end of the ejector nozzle; the smaller base is in the transverse plane at which a convergent section 53 and a divergent section 54 join together; the divergent section 54 is extended into a pipe 55 whose diameter is equal to that of the inlet of the elbow 52 connected to the outlet pipe 39 for water free of debris; the pipe 55 is connected to the outlet pipe 16 of the condenser 19.

The aspiration side of the pump 42 is connected to the pipe 55.

The separator 37 and the outlet pipe 39 for water free of debris are connected to the separator 37 by pipework 41 to supply it with recycled water.

The strainer 46 is long and the radial speed component is therefore small compared to the axial component: thus debris is pushed toward the back of the strainer, which is therefore self-cleaning.

There is a vent 44 at the top of the separator 37.

The installation for recovering debris can of course be shared by several filters.

The filter concerned is contraflow washed by opening its valve 49 and starting rotation of the filter.

The pump 42 is switched on; the ejector nozzle 51 increases the flow of washing water from which the debris has been removed by the separator 37.

When washing is finished, the pump 42 and the rotation of the filter are stopped and the valve 49 is closed.

The separator 37 is emptied by opening the vent 44 and the evacuation valve 40 at the bottom of the body of the separator 37; a check valve 56 on the outlet pipe 39 isolates the separator 37 from the downstream water pressure; the water on the outside of the strainer 46 contraflow washes the strainer when the separator 37 is emptied; the water and debris drop into the basket 38, in which the debris is drained.

When the separator 37 is empty, the evacuation valve 40 is closed and the separator 37 is refilled via the pipework 41; the vent 44 is closed when the separator is full.

The installation is then ready for a new cycle.

Of course, if the capacity of the separator 37 is high, given the quantity of debris to be treated, the operation of discharging the debris need not be done each time that the filters are washed.

The simplicity of the installation is evident.

The pump 42 is a constant flowrate pump and runs only during the washing operation.

What is claimed is:

1. An installation for recovering debris stopped by a filter at the inlet of a heat exchanger, characterized in that a washing water manifold (36) at the outlet of the filter (11) feeds a separator (37) provided with an outlet pipe (39) for water free of debris to which is connected hydro-ejector nozzle (50) which is connected to the outlet pipe (16) of the exchanger (19).

2. An installation according to claim 1, characterized in that the separator (37) is substantially vertical and includes a central strainer (46) passing through the body of the separator (37) which has in its bottom portion an axial outlet (47) controlled by a valve (40).

3. An installation according to claim 1, characterized in that the outlet pipe (39) for water free of debris extends radially relative to the body of the separator (37).

4. An installation according to claim 1, characterized in that the hydro-ejector (50) includes an inlet elbow (52) through whose external wall passes an ejector nozzle (51) whose external end is connected to the outlet of a pump (42) and whose internal end is frustoconical with the smaller base of the frustum of the cone at the same end as the ejector nozzle (51).

5. An installation according to claim 4, characterized in that the smaller base of the frustum of the cone is in the transverse plane at which a convergent section (53) and a divergent section (54) join together and said divergent section (54) is extended by a pipe (55) connected to the outlet pipe (16) of the exchanger (19).

6. An installation according to claim 5, characterized in that the aspiration side of the pump (42) is connected to said pipe (55).

7. An installation according to claim 5, characterized in that the outlet pipe (39) for water free of debris and the body of the separator (37) are connected by pipework (41).

8. An installation according to claim 5, characterized in that the outlet pipe (39) for water free of debris includes a check valve (56).

9. An installation according to claim 1, characterized in that the body of the separator (37) includes a vent (44).

10. An installation according to claim 1, characterized in that the filter (11) includes a filter member (13) in the general form of a wheel extending transversely in the body of the filter and adapted to rotate about the axis thereof.

11. An installation according to claim 6, characterized in that the outlet pipe (39) for water free of debris and the body of the separator (37) are connected by pipework (41).

12. An installation according to claim 2, characterized in that the outlet pipe (39) for water free of debris extends radially relative to the body of the separator (37).

* * * * *